US006986550B2

(12) United States Patent
Gevaert et al.

(10) Patent No.: US 6,986,550 B2
(45) Date of Patent: Jan. 17, 2006

(54) SEAT SLIDE ASSEMBLY

(75) Inventors: Steven C Gevaert, Green Bay, WI (US); Scott L Williams, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 10/866,576

(22) Filed: Jun. 12, 2004

(65) Prior Publication Data

US 2005/0275266 A1 Dec. 15, 2005

(51) Int. Cl.
*A47C 1/023* (2006.01)

(52) U.S. Cl. ..... 297/337; 297/344.1; 297/344.11; 297/340; 297/311

(58) Field of Classification Search ..... 297/311, 297/337, 340, 344.1, 344.11
See application file for complete search history.

(56) References Cited

U.S. PATENT DOCUMENTS

| | | | | |
|---|---|---|---|---|
| 1,326,417 | A | 12/1919 | Paine | |
| 2,312,030 | A | 2/1943 | Cramer et al. | |
| 2,409,114 | A | 10/1946 | Elleman et al. | |
| 2,755,842 | A | 7/1956 | Caramelli | |
| 3,542,326 | A | 11/1970 | Reapsummer | 297/344.1 X |
| 3,620,495 | A | 11/1971 | Korab | |
| 3,785,700 | A | 1/1974 | Kubo | |
| 3,982,785 | A | 9/1976 | Ambasz | |
| 4,086,676 | A | 5/1978 | Arruza | |
| 4,518,139 | A | 5/1985 | Barfell | |
| 4,570,997 | A | 2/1986 | Tanizaki et al. | |
| 4,635,890 | A | 1/1987 | Matsuda et al. | |
| 4,660,885 | A | 4/1987 | Suhr et al. | |
| 4,671,572 | A | 6/1987 | Young et al. | |
| 4,781,354 | A | 11/1988 | Nihei et al. | |
| 4,813,643 | A | 3/1989 | Nihei | |
| 5,083,738 | A | 1/1992 | Infanti | |
| 5,131,718 | A | 7/1992 | Cooper | |
| 5,171,063 | A | 12/1992 | Stidd | |
| 5,234,189 | A | 8/1993 | Myers | |
| 5,496,090 | A | 3/1996 | Emmett et al. | |
| 5,522,641 | A | 6/1996 | Infanti | |
| 5,575,449 | A | 11/1996 | Shinbori et al. | 297/344.1 X |
| 5,603,551 | A | 2/1997 | Sheehan | 297/344.1 |
| 5,634,537 | A | 6/1997 | Thorn | |
| 5,678,886 | A | 10/1997 | Infanti | |
| 5,702,084 | A | 12/1997 | Carnahan et al. | |
| 5,704,729 | A | 1/1998 | Carnahan et al. | |

(Continued)

*Primary Examiner*—Rodney B. White
(74) *Attorney, Agent, or Firm*—Boyle Fredrickson Newholm Stein & Gratz S.C.

(57) ABSTRACT

A seat slide assembly for a fixed seating arrangement allows for controlled horizontal movement of a seat in relation to a fixed vertical seat post. The seat slide assembly includes a cover configured for attachment to the bottom of a conventional seat, and a seat slide top member attached to the underside of the cover. The bottom of the seat slide top member is configured to receive and attach a pair of parallel ball-type bearing assemblies located on opposite sides of the seat slide assembly. Each bearing assembly is mounted to the underside of the seat slide top member, so that the bearing assemblies move along with the seat slide top member on an upper wall defined by a base. A spring biased seat slide retainer handle is operatively attached to the seat slide top member, and includes a retainer tab that engages a one of a series of spaced slots on a flange extending downwardly from a side of the base, for incremental controlled movement of the seat.

23 Claims, 4 Drawing Sheets

U.S. PATENT DOCUMENTS 5,720,462 A 2/1998 Brodersen
5,762,617 A 6/1998 Infanti
5,791,731 A 8/1998 Infanti
5,884,887 A 3/1999 Garelick et al. ..... 297/344.1
6,027,168 A * 2/2000 Crossman et al. ..... 297/337
6,059,345 A 5/2000 Yokota
6,079,786 A 6/2000 Kirkland et al.
6,116,183 A 9/2000 Crow et al.
6,135,556 A * 10/2000 Chu et al. ..... 297/337
6,145,929 A 11/2000 Gollahon ..... 297/344.1
6,231,126 B1 5/2001 Cheng
6,318,696 B1 11/2001 Downey et al.
6,322,036 B1 11/2001 Tame et al. ..... 297/344.11 X
6,325,456 B1 12/2001 Carnahan
6,336,619 B1 1/2002 Wahls
6,402,114 B1 6/2002 Carnahan et al.
6,427,962 B1 8/2002 Rohee et al.
6,523,897 B2 2/2003 Pan
6,588,850 B2 7/2003 Matsuo ..... 297/344.11 X
6,634,711 B2 * 10/2003 Phillips et al. ..... 297/337
6,688,692 B2 * 2/2004 Phillips et al. ..... 297/337
6,739,666 B2 * 5/2004 Alampi ..... 297/337
6,767,062 B2 * 7/2004 Piretti ..... 297/337
6,824,215 B2 * 11/2004 Koepke et al. ..... 297/337
6,827,402 B2 * 12/2004 Habermann et al. ..... 297/337
6,893,090 B1 * 5/2005 Van Deursen et al. .. 297/340 X
2001/0050503 A1 * 12/2001 Piretti ..... 297/337
2002/0190558 A1 * 12/2002 Phillips et al. ..... 297/337
2002/0190559 A1 * 12/2002 Phillips et al. ..... 297/337
2003/0067200 A1 * 4/2003 Habermann et al. ..... 297/337
2003/0189369 A1 * 10/2003 Alampi ..... 297/337
2005/0140195 A1 * 6/2005 Koepke et al. ..... 297/337

* cited by examiner

SEAT SLIDE ASSEMBLY

BACKGROUND AND SUMMARY OF THE INVENTION

This invention relates to fixed seating arrangements, and more particularly to a seat slide assembly for a fixed seating arrangement.

Fixed seating arrangements are commonly employed in classrooms, lecture halls, laboratories, restaurants and other areas. In one common arrangement seen in the prior art, a fixed seating arrangement includes a stationary base member mounted to a floor surface and connected to an upwardly extending table support pedestal. The pedestal is then typically connected to a horizontal seat support. Several such fixed seating arrangements utilize a cantilevered swing arm connected to the pedestal to support a seat member. In these cantilevered assemblies, a pivot member attached to the swing arm near the pedestal facilitates horizontal adjustment of the seat in relation to a table surface by a user. This horizontal adjustment is desirable for obvious reasons in that it is intended to allow for comfort, as well as ease of entry into and exit from the seating assembly.

Although swing arm assemblies are designed to allow individuals to enter and exit the attached seat with ease, they are limited in their ability to enable individuals of extreme height and weight to attain a fixed comfortable range from the desk, table or countertop. Most known swing arm assemblies simply freely pivot between an open position, wherein the seat is away from the desk or table, and a closed position, in which the seat is stationary under the table. The traditional swing arm arrangement does not allow different individuals to incrementally adjust their seat in relation to the table or lock in a comfortable distance from the table. This is problematic for individuals at the extremes of the typical weight and height standards. For these individuals, the prior art swing arm assemblies may position them in awkward uncomfortable positions either too close or too far from the table.

As an alternative to the cantilevered swing arm assemblies, fixed seating arrangments have developed to include seating assemblies wherein the seat is attached directly to a separate seat base member secured to the floor, as opposed to a swing arm attached to a pedestal. Although these alternative fixed seating arrangements provide a stable chair, they do not allow for the motion of the chair as in the prior art swing arm assemblies, and thus do not allow for horizontal adjustment of the chair in relation to the desk or table. Therefore, despite the advantages of these fixed seating arrangements, one of the shortcomings of these arrangements is that the seat is always located at a predetermined fixed distance from the front of the table or countertop. Usually, this predetermined distance is chosen to reflect the size of the average individual. As can readily be appreciated, because of the different physical characteristics of different people, this fixed distance is often uncomfortable to many individuals. That is, because of the limitations of the prior art fixed seating arrangements, an individual's height, physical stature or other physical characteristics may make it difficult and uncomfortable for them to sit comfortably at a table, desk or counter utilizing a fixed seating arrangement. The individual may not be able to comfortably work at a table assembly for extended periods of time. Accordingly, it has been found that some individuals, sitting at fixed seating arrangements in an educational environment, lose focus and attention when they are distracted by their discomfort as a result of a particular fixed seating arrangement, thereby resulting in a less than optimal learning environment.

A variety of seat slides and other means of lateral adjustment for seating assemblies are shown and described in U.S. Pat. No. 3,785,700 to Kubo, U.S. Pat. No. 4,086,676 to Arruza, U.S. Pat. No. 5,131,718 to Cooper, U.S. Pat. No. 5,522,641 to Infanti, U.S. Pat. No. 6,079,786 to Kirkland et al. all of which are hereby incorporated by reference. Despite these references, problems and disadvantages exist with such prior art designs. In some prior designs, the devices include complex mechanisms for rotation and translation operations. Several of these mechanisms are often difficult to operate, are expensive to construct due to a large number of components and are often not compact, rendering them impractical for many potential applications. Furthermore, many of these designs do not provide a cover over the translation mechanism, thus resulting in a cluttered and unsightly appearance beneath the chair.

In view of the foregoing, it is one object of the present invention to provide a seat slide assembly for a fixed seating arrangement that may be adjusted in a horizontal forward and backward direction so as to be, respectively, moved closer to or further away from a table, desk or work surface in order to comfortably accommodate individuals of various physical characteristics.

It is another object of the subject invention to provide a safe and easy-to-operate seat slide assembly wherein an attached seat may be readily moved away from or towards a table or work surface.

It is yet another object of the subject invention to provide a seat slide assembly including a readily accessible handle for actuating adjustment of the seat towards and away from the table or work surface, thereby facilitating ease of entry and exit as well as comfort for seated individuals of different physical characteristics. A still further object of the invention is to provide a method of assembling a seat slide using a cover, to hide components of the seat slide assembly.

It is another object of the invention to provide a seat slide system that uses fewer materials, and provides a more finished look than existing seat slides. Yet another object of the invention is to provide a method of assembly that can be used to relatively inexpensively manufacture a seat slide system. Still another object of the invention is to provide a seat slide which provides adequate structural support yet is economical to manufacture and easy to install using existing equipment.

Consistent with the foregoing objects, the present invention contemplates a seat slide for a fixed seating arrangement that allows for controlled horizontal movement in relation to a vertical seat post, as well as a method of assembling a seat slide.

In accordance with a first aspect of the invention, a seat slide includes a cover defining an upper and a lower attachment surface. The upper attachment surface is configured for attachment to the bottom of a seat, and a seat slide top member is attached to the lower attachment surface. Opposed sides of a bearing member are attached to the seat slide top member and to a seat base located below the seat slide top member. A seat slide handle connected to the seat slide top member is selectively engageable with the base, to allow for incremental adjustment of the slide top member. The seat slide further includes one or more bearing stress relief members attached to the seat base, which are configured to receive and support the bearing member. In one form, each stress relief member is in the form of a bracket attached to the seat base. The seat slide handle may be formed to include a tab configured to selectively engage openings formed in a side plate extension associated with the base, for selectively fixing the position of the seat.

The invention further contemplates a method of assembling a seat slide. This aspect of the invention includes the acts of providing a seat slide comprising a cover defining upper and lower attachment surfaces, a seat slide top member configured to be attached to the lower attachment surface, at least one bearing member configured to be attached to the seat slide top member and a seat base, and a seat slide handle configured to be connected to the seat slide top member. The method further includes the acts of providing a seat base and a chair having a seat mounting member attached beneath. In addition, the method contemplates the steps of attaching the bearing member to the seat base and attaching a handle to the seat slide top member, as well as attaching the bearing member to the seat slide top member and to the cover.

Another aspect of the invention contemplates a seat slide assembly, including a pair of bearings attached to a seat base which defines a side member having a plurality of adjustment slots. A seat slide plate is attached to the bearings, and a control member is attached to the seat slide plate. The control member is engageable with the adjustment slots on the seat base, thereby allowing for selective lateral adjustment of the seat slide plate in relation to the base.

These, and other aspects and objects of the present invention will be better appreciated and understood when considered in conjunction with the following description and the accompanying drawings. It should be understood, however, that the following description, while indicating a preferred embodiment of the present invention, is given by way of illustration and not of limitation. Many changes and modifications may be made within the scope of the present invention without departing from the spirit thereof, and the invention includes all such changes and modifications.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
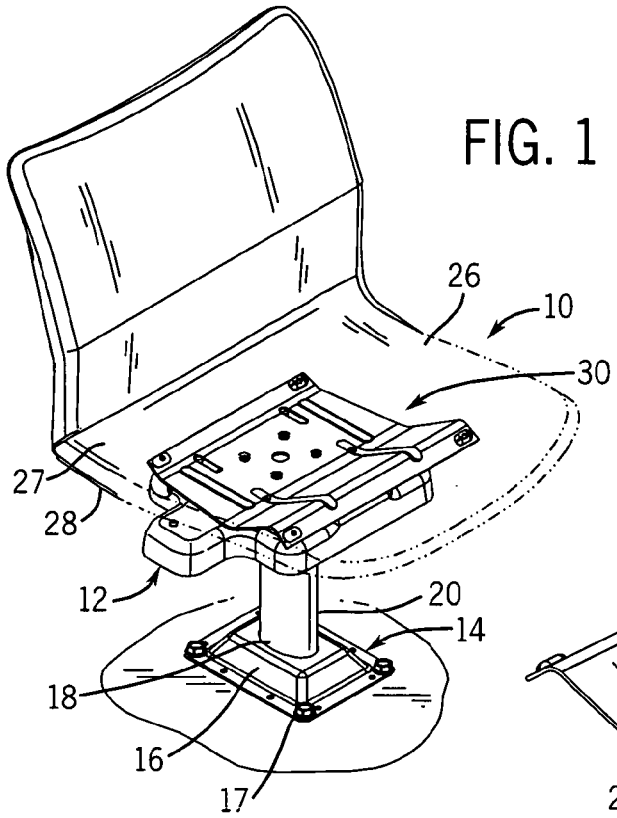
FIG. 1 is an isometric view of a fixed seating arrangement incorporating the seat slide of the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected" or terms similar thereto are often used. Such terms are not limited to direct connection but include connection through other elements where such connection is recognized as being equivalent by those skilled in the art.

Referring to FIG. 1, a fixed seating arrangement 10 incorporating a seat slide assembly 12 of the present invention includes a seat base 14 that includes a base plate 16 secured to a floor surface by a series of bolts or other securing means 17. Fixed seating arrangement 10 is designed to be used in conjunction with a wide variety of desks, tables, countertops or other work surfaces (not shown) by positioning the fixed seating arrangement 10 at a desired distance from the facing edge of the desk, table, etc. Furthermore, it should be understood that, although described in reference to a separate seat base 14, the inventive aspects of seat slide assembly 12 could be utilized in conjunction with many prior art swing arm assemblies as well and the exemplary seat base 14 illustrated is in no way limiting of the specific application of seat slide assembly 12 as shown and described.

Seat base 14 is known in the art and can take a variety of known configurations. In the illustrated embodiment shown in FIGS. 1 and 2, base plate 16 defines an opening 18 configured for use in mounting a seat post receiving tube 20. Receiving tube 20 can also take a variety of configurations, and is configured to receive a seat slide support post 22 of seat slide assembly 12. In the preferred embodiment illustrated in FIGS. 1 and 2, the receiving tube 20 includes inner 23 and outer 24 tubes. Inner tube 23 receives support post 22.

Figure 2:
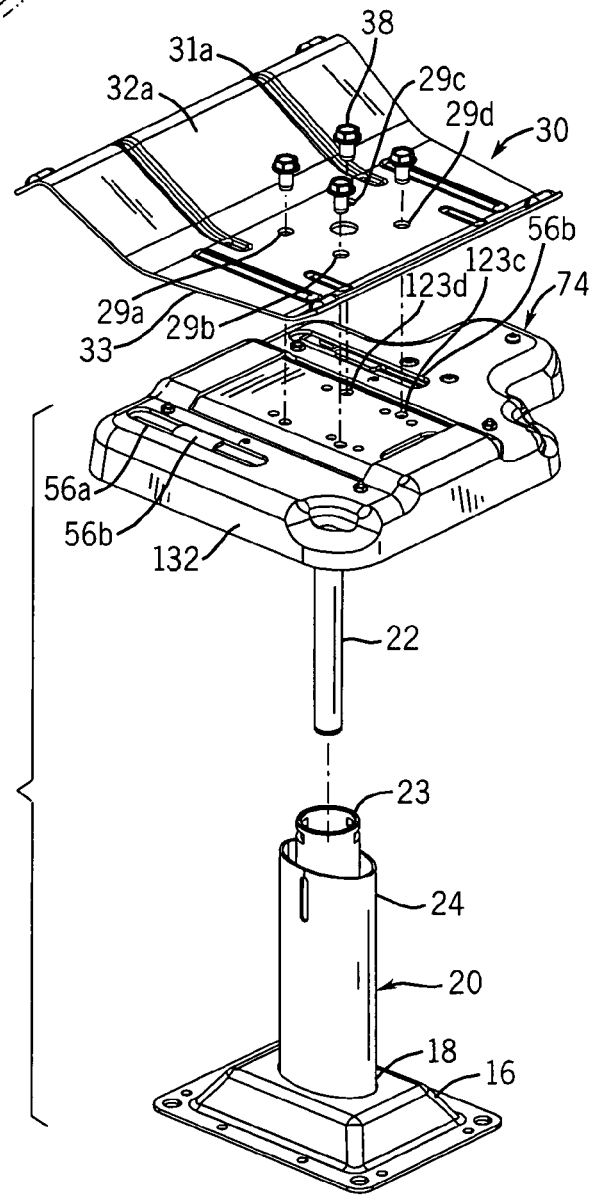
FIG. 2 is a partially exploded isometric view illustrating the attachment of the seat slide to a seat mounting member and a seat base.

Still referring to FIGS. 1 and 2, the fixed seating arrangement 10 includes a seat 26 defining an upper surface 27 for supporting an individual, and a bottom surface 28. The bottom surface 28 of the seat 26 is attached to a seat mounting member 30. It is understood that both the seat 26 and the seat mounting member 30 are illustrated by way of example and are no way limiting on the inventive seat slide assembly 12. The inventive seat slide assembly 12 can be used with a wide variety of alternative seats and mounting members. In the illustrated embodiment shown in FIGS. 1 and 2, mounting member 30 is comprised of two seat attachment flanges 31*a*, 31*b*, two angled support plates 32*a*, 32*b* and a flat attachment plate 33. The attachment plate 33 of the mounting member 30 is connected through cover 74 of the seat slide assembly 12 to a seat slide top member 54, using screws or other attachment means 38 inserted through attachment plate holes 29*a–d* and cover holes 123*a–d*.

Figure 3:
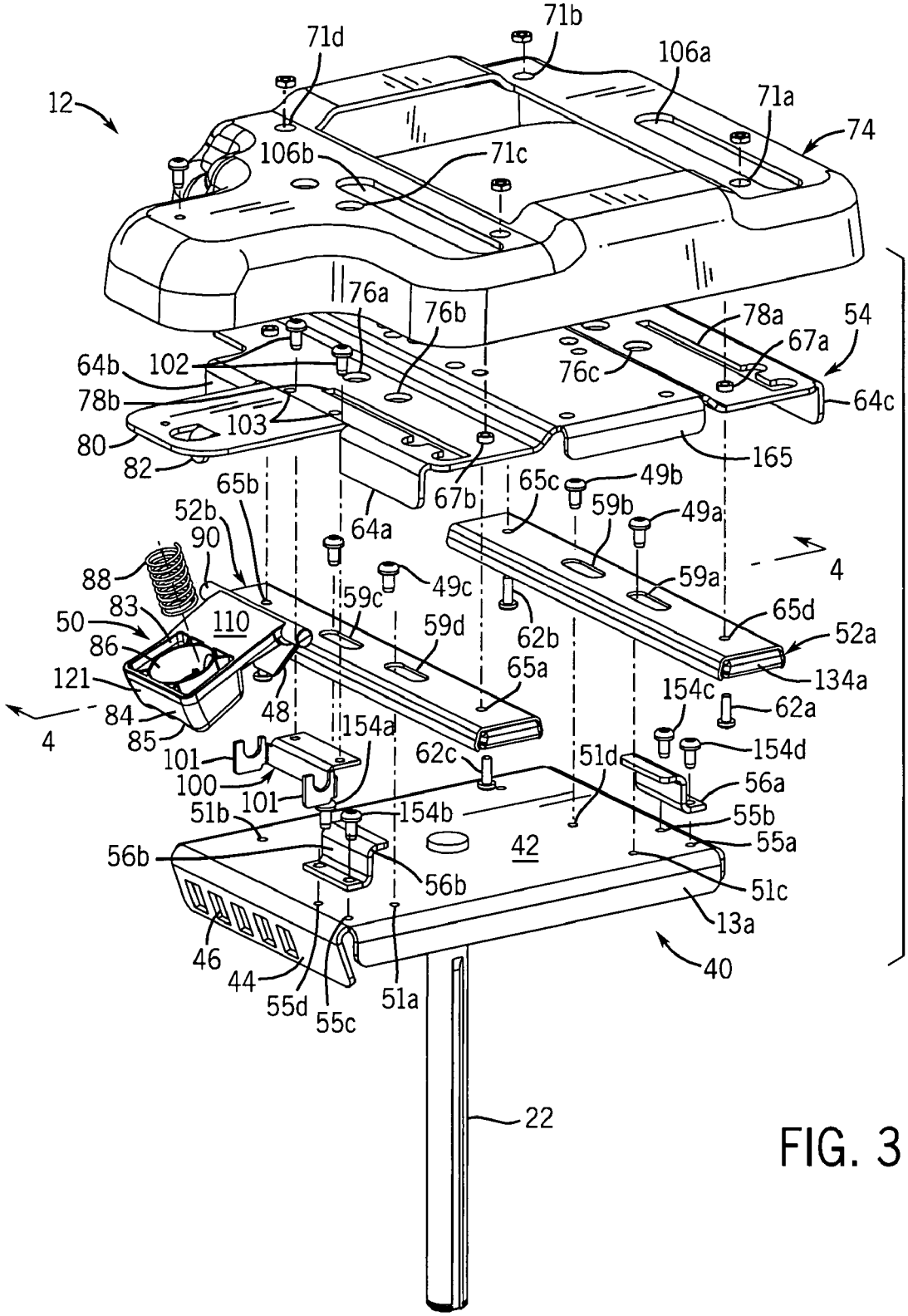
FIG. 3 is an exploded isometric view illustrating the components of the seat slide incorporated in the seating arrangement of FIGS. 1 and 2.

FIG. 3 illustrates the seat slide assembly 12 that is incorporated into the fixed seating arrangement 10. The seat slide assembly 12 includes a seat slide base 40 attached to an upper end of the support post 22. Base 40 includes a rectangular support plate 42 configured to support seat 26 and seat slide assembly 12. Extending downwardly from three edges of the support plate 42 are end flanges 13*a–c*. On a fourth edge of the support plate 42 is a downwardly extending slide adjustment flange 44. The slide adjustment flange 44 defines a series of spaced apart rectangular slots 46 configured to engage and retain a tab 48 of a seat slide handle assembly 50, as will be discussed in greater detail below. It is understood that the rectangular openings can take a wide variety of shapes and need not necessarily be rectangular as long as they are engageable with the seat slide handle tab 48.

Figure 4:
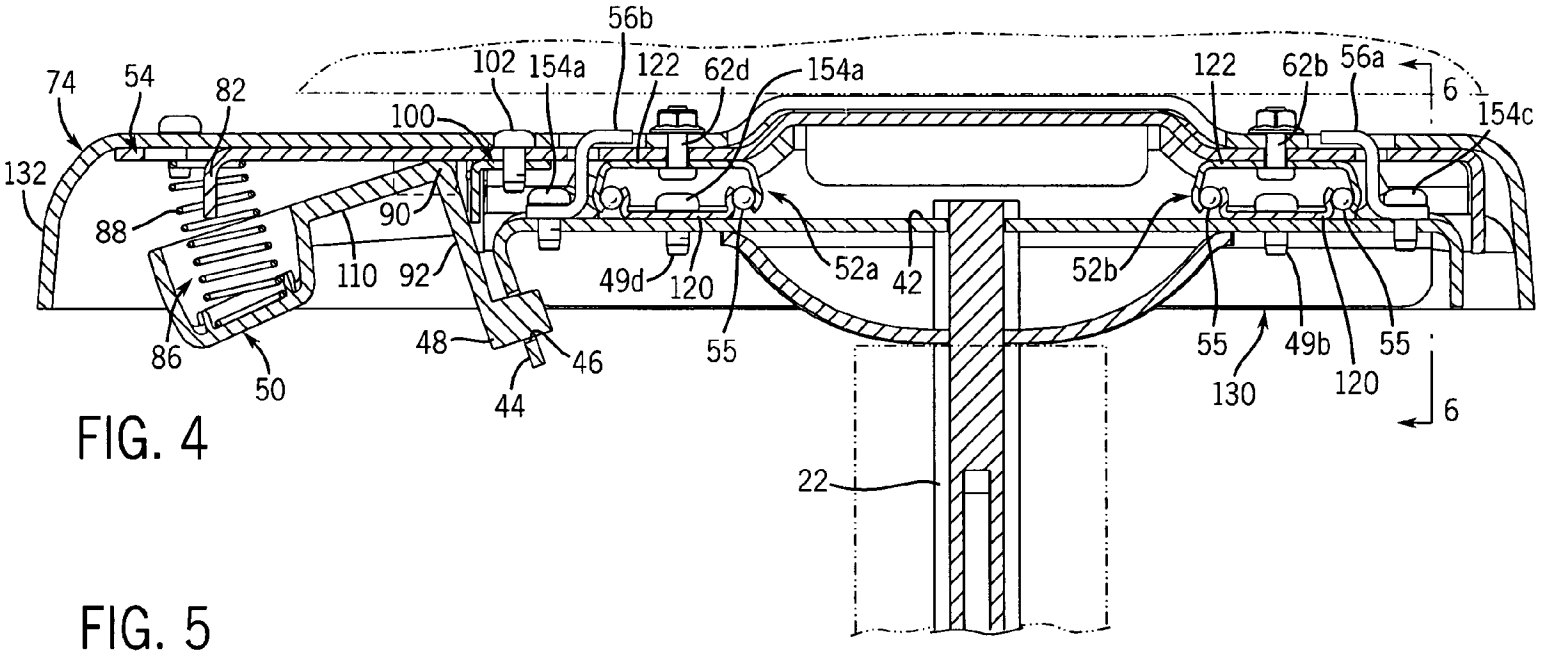
FIG. 4 is a section view of an assembled seat slide taken along lines 4—4 of FIG. 3, illustrating the slide handle in its locked position.

A pair of ball bearing assemblies 52*a* and 52*b* are secured to opposed sides of the support plate 42. In the illustrated embodiment, ball bearing assemblies 52*a,* 52*b* are engaged with support plate 42 via by screws 49*a–d,* which are inserted through openings 59*a–*59*d* formed in the fixed bottom members of bearing assemblies 52*a,* 52*b* into engagement with aligned threaded openings formed in the upwardly facing surface of support plate 42 through holes 51*a–*51*d.* FIG. 4 illustrates each bearing assembly 52*a* and 52*b* in cross section, and it can be appreciated that each bearing assembly includes a fixed bottom member 120, through which screws 49*a–*49*d* extend, in combination with a movable top member 122. Bearings 52*a,* 52*b* can be of the conventional telescoping drawer slide roller type or other known bearing, and are configured to allow for ease of sliding of seat slide top member 54 relative to the support plate 42. In the illustrated embodiment, bearings 52*a,* 52*b* include a series of balls 55 that are trapped between facing surfaces of each bottom member 120 and top member 122, to provide smooth telescoping movement of top member 122 relative to bottom member 120. Screws 49*a–d* can be accessed and are inserted through slots 59*a–d* formed in top members 122 of bearings 52*a,* 52*b.*

In order to provide vertical strain relief for the bearings 52*a,* 52*b,* a pair of brackets 56*a,* 56*b* are secured to the support plate 42 by screws 154*a–d* inserted through holes 55*a–d.* The brackets 56*a,* 56*b* define lower flanges that engage support plate 42, and are configured to fit around bearing assemblies 52*a,* 52*b* so as to define an upper flange that overlies each bearing 52*a,* 52*b.* With this construction, brackets 56*a,* 56*b* do not impede horizontal movement of the bearings 52*a,* 52*b,* and function to prevent upward movement of bearings 52*a,* 52*b,* which may be caused by application of an upward force to seat 26, e.g. by a user leaning back on chair 26. The free ends of brackets 56*a,* 56*b* extend through aligned top member slots 78*a,* 78*b* and cover slots 106*a,* 106*b* thereby avoiding any interference with the sliding of the top member 54 across support plate 42.

Seat slide top member 54 is secured to the slidable top member 122 of the bearings 52*a,* 52*b.* Top member 54 is secured by nut and bolt assemblies 62*a–d* or other securing means, which extend through aligned openings in seat slide top member 54 and bearing top members 122. As illustrated in FIG. 3, the nut and bolt assemblies 62*a–d* extend through bearing holes 65*a–d* and seat slide top member holes 67*a–d,* as well as through cover holes 69*a–d* formed in cover member 74. Therefore, nut and bolt assemblies 62*a–d* effectively secure the slidable top members 122 of the bearings 52*a,* 52*b,* top member 54 and cover 74 to each other. The upper flange of each bracket 56*a,* 56*b* overlies the area of cover member 74 that overlies the respective bearing 52*a,* 52*b.* As noted above, bearings 52*a,* 52*b* allow top member 54 and attached cover 74 to slide across support plate 42.

Top member 54 includes downwardly extending side flanges 64*a–d* configured to substantially align with the end flanges 13*a–c* of the support plate 42, and with front flange 165. Top member 54 also includes access holes 76*a–d* that allow access to screws 154*a–d* securing brackets 56*a,* 56*b* to support plate 42, as well as access slots 78*a,* 78*b* that allow access to bearing screws 49*a–d* during assembly or repair.

Top member 54 further includes a seat slide handle extension 80 extending from one side. Handle extension 80 is a generally rectangular shaped plate including a centrally located spring engagement tab 82 projecting downwardly therefrom. Spring engagement tab 82 is configured to receive one end of a spring 88, which is configured to bias handle assembly 50 away from handle extension 80. The spring biasing of handle assembly 50 facilitates controlled incremental sliding movement of the seat slide assembly 12, as will be discussed below.

As illustrated in FIG. 3, handle assembly 50 includes a rectangular handle member 121 defining an inner side 83 and an outer side 84. Outer side 84 of handle 121 is configured to be accessible and manipulated by a user's hand. Outer side 84 of handle 121 may include such features as ergonomic grooves or recesses 85 configured to comfortably engage the fingers of a user. Inner side 83 of handle 121 defines a spring receiving cavity 86 configured to receive one end of coil spring 88. Extending from the handle 121 is an extension 110 connected to a pivot member 90 having a circular cross section. Pivot member 90 further includes a downwardly projecting slot engagement flange 92 that includes rectangular tab 48 at its distal end. Handle assembly 50 is attached to top member 54 via a mounting bracket 100, which includes ears 101 having arcuate recesses configured to fit over pivot member 90 while allowing for pivotal movement therein. Brackets 100 are secured to top member 54 via screws 102 inserted through holes 103.

Figure 5:
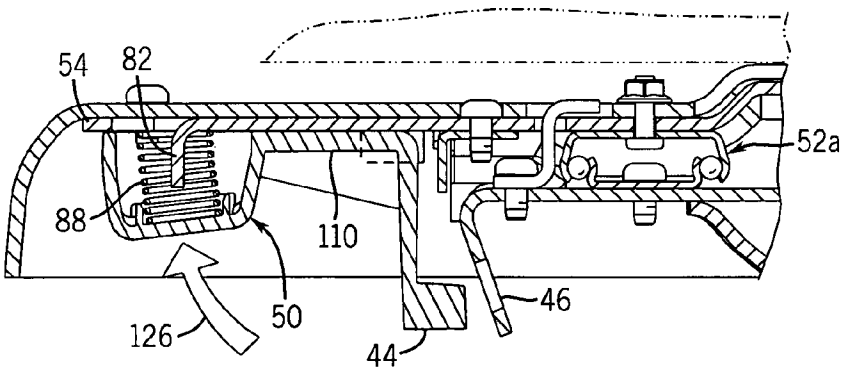
FIG. 5 is a partial section view of a portion of the seat slide of FIG. 4, showing the slide handle in its unlocked position.
Figure 6:
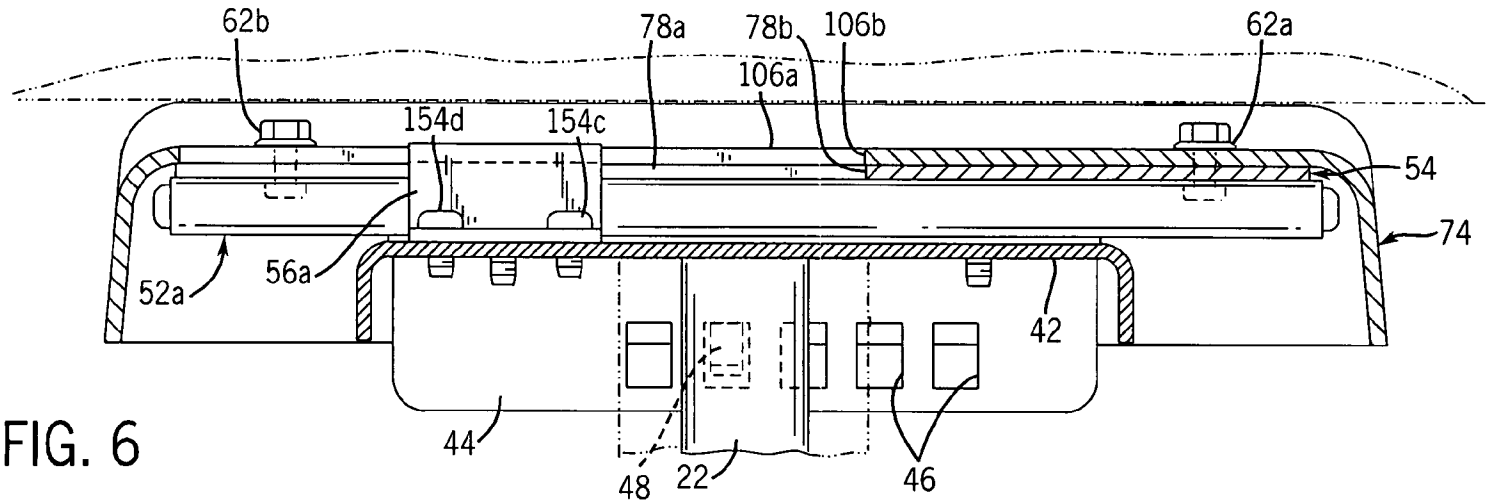
FIG. 6 is a partial section view of an assembled seat slide taken along lines 6—6 of FIG. 4, illustrating the seat slide in a first position.

Referring now to FIGS. 4–6, movement of pivot member 90 is operable to move integral flange 92 and attached tab 48 away from or toward adjustment flange 44. Under normal operating conditions as illustrated in FIG. 4, when no upward pressure is applied to handle assembly 50, the top member 54 and thus attached seat 26 are fixed in a stationary position due to engagement of tab 48 within one of slots 46. In a fixed stationary position, spring 88 is biased between top member 54 via spring engagement tab 82, and handle assembly 50 via spring receiving cavity 86. Spring 88 exerts sufficient pressure on integral handle 121, attached extension 110 and pivot member 90 to forceably maintain tab 48 within the rectangular slot 46 on the adjustment flange 44. When tab 48 is fixed within rectangular slot 46, horizontal sliding movement of top member 54 on support plate 42 via bearings 52*a,* 52*b* is prevented. When a user desires to adjust the seat configuration, upward pressure is applied to the handle assembly 50 to move it in an upward direction towards the top member 54, in the direction indicated by the arrow 126 shown in FIG. 5. Upon application of such upward pressure, the biasing force of spring 88 is overcome, and tab 48 is withdrawn from the rectangular slot 46. Top member 54 is then free to slide over support plate 42 along bearings 52*a,* 52*b,* to enable a user to position seat 26 in a desired position. When the upward pressure is released, spring 88 biases handle assembly 50 downwardly, thereby causing pivot member 90 and tab 48 to move towards adjustment flange 44 such that tab 48 engages the aligned rectangular slot 46 on the adjustment flange 44. If necessary, the user moves seat 26 slightly so as to ensure that tab 48 is moved into engagement with one of slots 46. It should be understood that spring 88 may be replace with a torsion spring, or any other satisfactory biasing arrangement, for urging tab 48 toward slots 46. It should also be understood that the location of tab 48 and slots 46 may be reversed, in that handle assembly 50 may have a recess and adjustment flange 44 may have a series of projections configure to receive the recess, to selectively maintain seat 26 in position.

Figure 7:
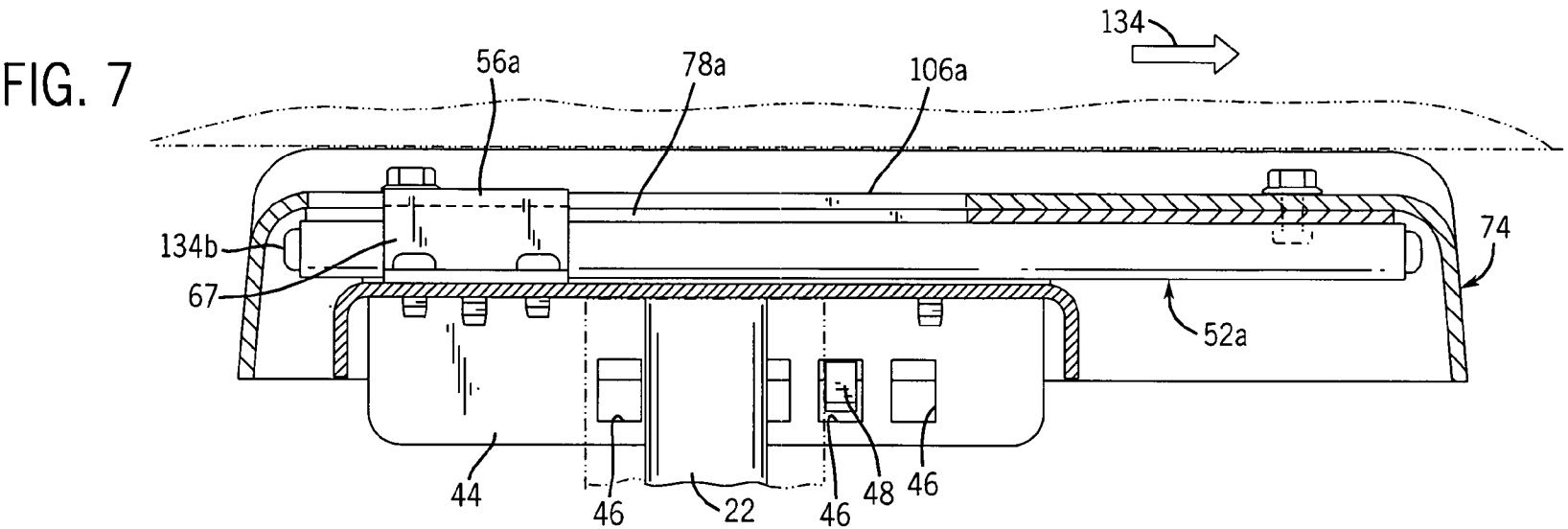
FIG. 7 is a partial section view similar to FIG. 6, illustrating the seat slide in a second forward position.

FIGS. 6 and 7 further illustrate the horizontal sliding motion of the seat slide assembly 12. FIG. 6 illustrates the seat slide assembly 12 having the tab 48 engaged in the second rectangular slot 46. Upon actuation of the handle 121, tab 48 is disengaged from the rectangular slot 46 as discussed above, and top member 54 and attached cover 74 slide along bearings 52*a,* 52*b* in a direction chosen by a user. For example the top member 54 may move in the direction indicated by the arrow 134 shown in FIG. 6. As illustrated by FIG. 7, top member 54 and cover 74 may be moved to any desired position, e.g. a distance of two rectangular slots 46. As noted above, when top member 54 and cover 74 slide, brackets 56*a,* 56*b* do not impede travel by virtue of the aligned slots 106*a,* 106*b* and 78*a,* 78*b* discussed above. Upon release of the handle assembly 50, spring will bias handle assembly 50 back and attached tab 48 back into a new rectangular slot 46 on adjustment flange 44. In addition to tabs 48, sliding is limited by bearing stops 134*a,* 134*b.*

In operation, a user approaches the fixed seating arrangement 10, which is usually mounted in combination with a table, desk, countertop or other worksurface (not shown). If, for example, the seat 26 was left in a position too close to a table, an individual can actuate the handle assembly 50 and slide the seat 26 away from the table edge to allow for ease of entry. Once seated, a user can then actuate the handle assembly 50 and slide toward the table to a distance that is comfortable for the intended use.

With the construction as shown and described, all of the components associated with the seat slide assembly are hidden from view by cover 74. As illustrated in FIGS. 4-7, cover sides 132 define an inner cavity 130 in which a majority of the components of the seat slide assembly 12 are housed. Thus, when one looks at the seat side assembly 12 from a horizontal or vertical view, the components of the seat slide assembly are hidden. Therefore, not only does cover 74 provide a more finished look than prior art seat slide arrangements, it also serves to prevent exposure of the slide assembly 12 components to moisture, dirt, dust or other contaminants. This is a significant advantage over the prior art both functionally and aesthetically, in which the component parts of the seat slide are often exposed. This construction further provides the advantage of a lightweight, strong and low profile slide that requires fewer component parts than many of the prior art assemblies While the above description is given by way of example, it is recognized that numerous other configurations could be utilized with the inventive aspects of the seat slide assembly 12 and are included in the present invention. Although the best mode contemplated by the inventor of carrying out the present invention is disclosed above, practice of the present invention is not limited thereto. As noted throughout the application, numerous alternative configurations of seats could be used with the seat slide assembly 12. It will be manifest that various additions, modifications and rearrangements of the features of the present invention may be made without deviating from the spirit and scope of the underlying inventive concept. Moreover, the individual components need not be formed in the disclosed shapes, or assembled in the disclosed configuration, but could be provided in a variety of shapes, and assembled in a variety of configurations.

All such alternatives, additions, modifications and rearrangements are contemplated as being within the scope of the following claims particularly pointing out and distinctly claiming the subject matter regarded as the invention.

We claim:

1. A seat slide, comprising:

a seat base defining a support surface;

a seat slide top member configured for attachment to a seat;

at least one bearing assembly attached between the support surface of the seat base and the seat slide top member, wherein the bearing assembly includes an upper bearing member secured to the seat slide top member, a lower bearing member secured to the seat base, and a series of axially aligned bearings interposed between the upper bearing member and the lower bearing member to enable axial movement of the upper bearing member relative to the lower bearing member, and thereby the seat slide top member relative to the seat base; and a retainer arrangement interposed between the seat base and the seat slide top member for selectively fixing the position of the seat relative to the seat base.

2. The seat slide of claim 1, wherein the retainer arrangement includes a handle pivotally connected to the seat slide top member and selectively engageable with the seat base.

3. The seat slide of claim 2, wherein the seat base includes a side plate having a series of aligned openings, and wherein the handle is interconnected with a tab configured to selectively engage at least one of the openings in the side plate.

4. The seat slide of claim 3, further comprising a spring interposed between the handle and the seat slide top member for biasing the handle toward an engaged position in which the tab is received within at least one of the openings in the side plate.

5. The seat slide of claim 4, wherein the seat slide top member includes a lateral extension having a downwardly projecting tab configured to engage a first end defined by the spring, and wherein the handle defines a spring receiving recess within which a second end defined by the spring is received.

6. The seat slide of claim 2, wherein the handle is attached to the seat slide top member by a bracket.

7. The seat slide of claim 1, further comprising at least one bearing stress relief member attached to the seat base and configured to overlie the upper bearing member, wherein the stress relief member is configured to prevent upward movement of the bearing assembly relative to the seat base.

8. The seat slide of claim 7, wherein the stress relief member comprises at least one bracket attached to the seat base.

9. A method of assembling a seat slide, comprising the acts of:

providing a seat slide comprising:

a seat slide top member;

at least one bearing assembly having an upper bearing member secured to the seat slide top member, lower bearing member, and a series of axially aligned bearings interposed between the upper bearing member and the lower bearing member to enable axial movement of the upper bearing member relative to the lower bearing member; and a retainer arrangement;

providing a chair having a seat mounting member interconnecting the seat slide top member with the mounting member of the chair so as to secure the upper bearing member of the bearing assembly to the chair;

providing a base;

attaching the lower bearing member to the base to enable axial movement of the seat slide top member, and thereby the seat, relative to the base; and interconnecting the retainer arrangement between the seat slide top member and the base.

10. The method of claim 9, wherein the act of interconnecting the retainer arrangement between the seat slide top member and the base includes pivotally connecting a handle of the retainer arrangement to the seat slide top member, wherein the handle is selectively engageable with the base to selectively maintain the axial position of the seat relative to the base.

11. The method of claim 10, wherein the step of interconnecting the retainer arrangement between the seat slide top member and the base is carried out by engaging a tab associated with the handle with one of a plurality of openings on a side plate extension of the base.

12. The method of claim 11, further comprising the act of biasing the tab associated with the handle toward engagement within one of the plurality of openings on the side plate extension of the base.

13. The method of claim 12, wherein the act of biasing the tab toward engagement within one of the plurality of openings on the side plate extension of the base is carried out by a coil spring, and wherein the seat slide top member includes a lateral extension including a downwardly projecting tab configured to engage a first end defined by the coil spring.

14. The method of claim 13, wherein the handle defines a spring receiving portion which engages a second end defined by the coil spring, wherein the coil spring applies a biasing force between the handle and the lateral extension of the seat slide top member to urge the tab toward engagement within one of the plurality of openings on the side plate extension of the base.

15. The method of claim 10, wherein the act of pivotally connecting the handle to the seat slide top member is carried out by securing a bracket to the seat slide top member.

16. The method of claim 9 further comprising the act of attaching at least one bearing stress relief member to the base so as to overlie the upper bearing member of the bearing assembly.

17. The method of claim 16, wherein the stress relief member comprises at least one bracket attached to the base.

18. A seat slide assembly, comprising:

a pair of bearings assemblies attached to a seat base which includes a side member having a plurality of adjustment slots, wherein each bearing assembly includes an upper bearing member, a lower bearing member secured to the seat base, and a series of axially aligned bearings interposed between the upper bearing member and the lower bearing member to enable axial movement of the upper bearing member relative to the lower bearing member;

a seat slide plate attached to the upper bearings member of each bearing assembly, wherein the seat slide plate is axially slidable relative to the base via the aligned bearings; and a movable retainer member attached to the seat slide plate and selectively engageable with the plurality of adjustment slots, to provide selective axial adjustment of the seat slide plate in relation to the base.

19. The seat slide assembly of claim 18, further comprising a spring interposed between the retainer member and the seat slide plate for biasing the retainer member toward the base side member into engagement with the plurality of adjustment slots.

20. The seat slide assembly of claim 19, wherein the retainer member comprises a handle defining a spring receiving region and the seat slide plate comprises a spring engagement member, wherein the spring defines a first end engaged with the spring receiving region and a second end engaged with the spring engagement member.

21. The seat slide assembly of claim 18, further comprising a pair of strain relief brackets mounted to the base, wherein each strain relief bracket overlies the upper bearing member of one of the bearing assemblies to prevent upward movement of the bearing assembly.

22. The seat slide assembly of claim 18, wherein the seat slide assembly is located below a seat, and further comprising a cover secured to the seat slide plate, wherein the cover is interposed between the seat slide plate and the seat.

23. The seat slide assembly of claim 22, wherein the cover includes downwardly extending side walls configured to surround and shield the seat slide plate, the bearings assemblies and the retainer member.

* * * * *

UNITED STATES PATENT AND TRADEMARK OFFICE

CERTIFICATE OF CORRECTION

PATENT NO. : 6,986,550 B2
DATED : January 17, 2006
INVENTOR(S) : Steven C. Gevaert et al.

It is certified that error appears in the above-identified patent and that said Letters Patent is hereby corrected as shown below:

Column 9,
Line 33, delete “bearings” and substitute -- bearing --;

Column 10,
Line 4, delete “bearings” and substitute -- bearing --.

Signed and Sealed this

Twenty-first Day of March, 2006

JON W. DUDAS
*Director of the United States Patent and Trademark Office*